US012790063B2

(12) United States Patent
Kamiyama et al.

(10) Patent No.: US 12,790,063 B2
(45) Date of Patent: Nov. 10, 2026

(54) BOTTOMED METAL CYLINDER

(71) Applicant: TOYO SEIKAN CO., LTD., Tokyo (JP)

(72) Inventors: Kota Kamiyama, Yokohama (JP); Tomohiko Nakamura, Yokohama (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 0 days.

(21) Appl. No.: 18/905,314

(22) Filed: Oct. 3, 2024

(65) Prior Publication Data

US 2025/0026526 A1 Jan. 23, 2025

Related U.S. Application Data

(63) Continuation of application No. PCT/JP2023/003216, filed on Feb. 1, 2023.

(30) Foreign Application Priority Data

Apr. 4, 2022 (JP) ..... 2022-062300

(51) Int. Cl.
*B65D 1/16* (2006.01)
*B21D 51/26* (2006.01)

(52) U.S. Cl.
CPC ..... *B65D 1/165* (2013.01); *B21D 51/2669* (2013.01)

(58) Field of Classification Search
CPC ..... B21D 22/28; B21D 24/04; B21D 51/26; B21D 51/2669; B65D 1/165
See application file for complete search history.

(56) References Cited

U.S. PATENT DOCUMENTS 4,289,014 A * 9/1981 Maeder ..... B21D 22/30 72/341
4,620,434 A * 11/1986 Pulciano ..... B21D 22/30 72/347
4,723,433 A 2/1988 Grims
4,768,672 A 9/1988 Pulciani et al.
4,790,169 A * 12/1988 Johansson ..... B21D 51/26 72/354.8
5,522,248 A * 6/1996 Diekhoff ..... B21D 22/22 72/348

(Continued)

FOREIGN PATENT DOCUMENTS

CA 1224430 A 7/1987
DE 3587397 T2 5/1994

(Continued)

OTHER PUBLICATIONS

International Search Report in International Application No. PCT/JP2023/003216, dated Mar. 14, 2023.

(Continued)

*Primary Examiner* — Edward T Tolan
(74) *Attorney, Agent, or Firm* — Sughrue Mion, PLLC

(57) ABSTRACT

A bottomed metal cylinder includes, at a bottom portion, a ground contact portion, a rising portion extending upward from an inner side of the ground contact portion, and a dome-shaped bottom surface extending to the rising portion. An annular line originating from a local thin portion is observed at a peripheral edge portion of the dome-shaped bottom surface.

1 Claim, 6 Drawing Sheets

(56) References Cited

U.S. PATENT DOCUMENTS

| | | | | |
|---|---|---|---|---|
| 6,434,996 | B1 * | 8/2002 | Aschberger ..... | B21D 22/30 72/348 |
| 10,525,519 | B2 | 1/2020 | Carstens et al. | |
| 2001/0045116 | A1 | 11/2001 | Hanafusa et al. | |

FOREIGN PATENT DOCUMENTS

| | | | |
|---|---|---|---|
| DE | 102015215590 | A1 | 2/2017 |
| GB | 2237763 | A | 5/1991 |
| JP | 04-371332 | A | 12/1992 |
| JP | H11-104764 | A | 4/1999 |
| JP | 2000-211624 | A | 8/2000 |
| JP | 2009-078303 | A | 4/2009 |
| JP | 2018-177289 | A | 11/2018 |
| WO | 2018/195525 | A1 | 10/2018 |

OTHER PUBLICATIONS

Chinese Office Action dated Jan. 10, 2026, issued in Chinese application No. 202380028603.X.
Partial Supplementary European Search Report dated Mar. 19, 2026, issued in European application No. 23784515.1.

* cited by examiner

BOTTOMED METAL CYLINDER

CROSS-REFERENCE TO RELATED APPLICATIONS

This application is a Rule 53(b) Continuation of International Application No. PCT/JP2023/003216 filed Feb. 2, 2023, which claims priority based on Japanese Patent Application No. 2022-062300 filed Apr. 4, 2022, the respective disclosures of which are incorporated herein by reference in their entirety.

TECHNICAL FIELD

The disclosure relates to a bottomed metal cylinder having a dome-shaped bottom surface, such as a seamless metal can, for example, and further relates to a molding die used for molding the dome-shaped bottom surface and to a doming method using the molding die.

BACKGROUND

Typically, for a bottomed metal cylinder, such as a seamless can, for example, obtained by a metal molding process (punching, drawing, and ironing), a bottom portion is recessed into a dome shape to reduce weight, improve pressure resistance performance, and stabilize placement. The molding of such a bottom portion is called doming, and is performed by holding a bottom portion peripheral edge of the cylinder by an annular die called a hold ring and pushing up a doming die from within the annular mold, thereby recessing a bottom surface of the cylinder into a dome shape (refer to JP 2018-177289 A).

The dome-shaped bottom surface formed as described above has a problem in that wrinkling is likely to occur at a peripheral edge portion. Such wrinkling is particularly noticeable on aluminum cans. These wrinkles, being formed at a bottom surface, have not been significantly problematic in the past. However, beverage cans, such as aluminum seamless cans, nowadays are often placed and sold with the bottom portion of the can being visible, resulting in a recent demand for improvement.

SUMMARY

Accordingly, an object of the disclosure is to provide a bottomed metal cylinder including a dome-shaped bottom portion that is wrinkle-free.

Another object of the disclosure is to provide a molding die used for dome molding (doming) a bottom portion of the bottomed metal cylinder described above and a dome molding method using the molding die.

According to the disclosure, provided is a bottomed metal cylinder including, at a bottom portion, a ground contact portion, a rising portion extending upward from an inner side of the ground contact portion, and a dome-shaped bottom surface extending to the rising portion. An annular line is observed at a peripheral edge portion of the dome-shaped bottom surface.

In the bottomed metal cylinder according to the disclosure, preferably (1) the bottomed metal cylinder is an aluminum seamless can.

According to the disclosure, further provided is a molding die used for dome-molding a bottom portion of a bottomed metal cylinder. The molding die includes an annular holding die for holding a bottom portion peripheral edge of the bottomed metal cylinder, and a doming die for defining a dome-shaped bottom surface. The doming die is divided into a doming ring for defining a peripheral edge portion of the dome-shaped bottom surface and a base die for defining a center portion of the dome-shaped bottom surface inward of the peripheral edge portion. The doming ring and the base die are each independently vertically movable.

According to the disclosure, yet further provided is a method for doming a bottom portion of a bottomed metal cylinder. The method includes preparing the molding die described above, lowering a punch sleeve from inside the bottomed metal cylinder and pressing a lower end peripheral edge portion of the cylinder against a working surface of the annular holding die, to form a chime portion and a ground contact portion at a bottom surface peripheral edge portion of the cylinder, raising the doming ring while holding the chime portion and the ground contact portion of the cylinder by the punch sleeve and the working surface of the annular holding die to form a rising portion and a peripheral edge portion of a dome-shaped bottom surface inside the ground contact portion, and arranging a base die to form a center portion of the dome-shaped bottom surface.

A bottomed metal cylinder according to the disclosure includes a dome-shaped bottom surface recessed into a dome shape, a dome-shaped peripheral edge portion thereof being free of wrinkles and, instead, observed as including an annular line.

In the disclosure, a die used for molding, that is, dome-molding, a cylinder bottom portion is divided into a doming ring for defining a peripheral edge portion of a dome-shaped bottom surface and a base die for defining a center portion of the dome-shaped bottom surface inward of the peripheral edge portion, and a surface of the peripheral edge portion of the dome-shaped bottom surface is formed by a dedicated die called a doming ring. As a result, the surface of the peripheral edge portion of the dome-shaped bottom surface is stretched and thinned, thereby preventing the occurrence of wrinkles with this thinning. In short, because doming is performed by using a dedicated doming ring that determines the peripheral edge portion of the dome-shaped bottom surface, the portion thinned by this doming ring has a dent, and the trace of an inner end portion of the doming ring is observed as an annular line.

Thus, in the metal cylinder according to the disclosure, the annular line is observed in the peripheral edge portion of the dome-shaped bottom surface instead of wrinkles, thereby making it possible to not impair appearance and secure a high commercial value when the metal cylinder is used as a beverage can, for example.

DESCRIPTION OF EMBODIMENTS

Form of Bottomed Metal Cylinder

A bottomed metal cylinder according to the disclosure is obtained by, for example, punching, drawing, and redrawing-ironing a thin element plate made of metal, then doming a bottom portion thereof and, lastly, subsequently performing post-processing such as washing and drying, outer surface printing, finishing varnish application and baking, inner surface coating application and baking, neck-in processing, and flange processing. The final form is typically, as a whole, as illustrated in FIG. 1.

Figure 1:
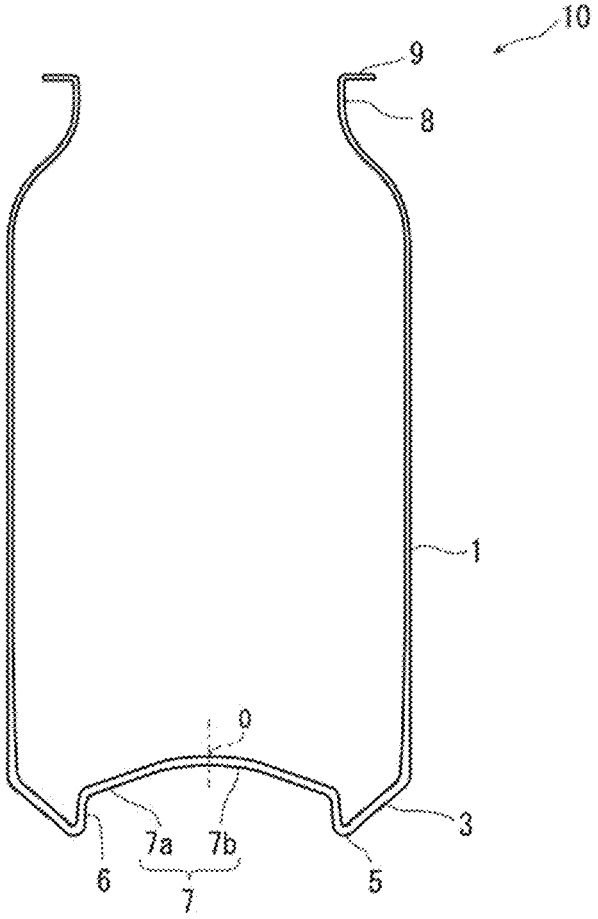
FIG. 1 is a schematic side cross-sectional view illustrating a bottomed metal cylinder according to the disclosure in its entirety.

With reference to FIG. 1, the bottomed metal cylinder according to the disclosure denoted by 10 as a whole includes a body portion 1 provided with an outer surface having a straight cylindrical shape, a ground contact portion 5 formed from a lower end of the body portion 1 with a chime portion 3, inclined inwardly, interposed therebetween, and a dome-shaped bottom surface 7 positioned in a region surrounded by the ground contact portion 5. Further, an upper portion of the body portion 1 extends to a neck-in portion 8 formed by post-processing, and a flange portion 9 is formed on an upper end of the neck-in portion 8.

The dome-shaped bottom surface 7 is composed of a peripheral edge portion 7*a* extending to an upper end of a rising portion 6 rising inwardly from the ground contact portion 5, and a center portion 7*b* surrounded by the peripheral edge portion 7*a*. The peripheral edge portion 7*a* corresponds to a portion with which a doming ring used at the time of doming described below comes into contact, and has a length of about 2 to 30 mm in a side cross-sectional view. Such a dome-shaped bottom surface 7 composed of the peripheral edge portion 7*a* and the center portion 7*b* has a large, substantially constant radius of curvature as a whole in a side cross-sectional view and, with formation of the bottom surface 7 in such a form at the bottom portion, it is possible to stably place this bottomed cylinder 10 and further increase a load strength thereof in an axial direction.

In the disclosure, the metal constituting the bottomed cylinder 10 described above is not particularly limited and may be various metals or alloys, but aluminum or an aluminum alloy is preferable from viewpoints such as weight reduction and thin-wall workability, and a seamless can coated on an inner surface with an organic resin is preferable from the viewpoint of taking advantage of the merits of the disclosure.

Figure 2:
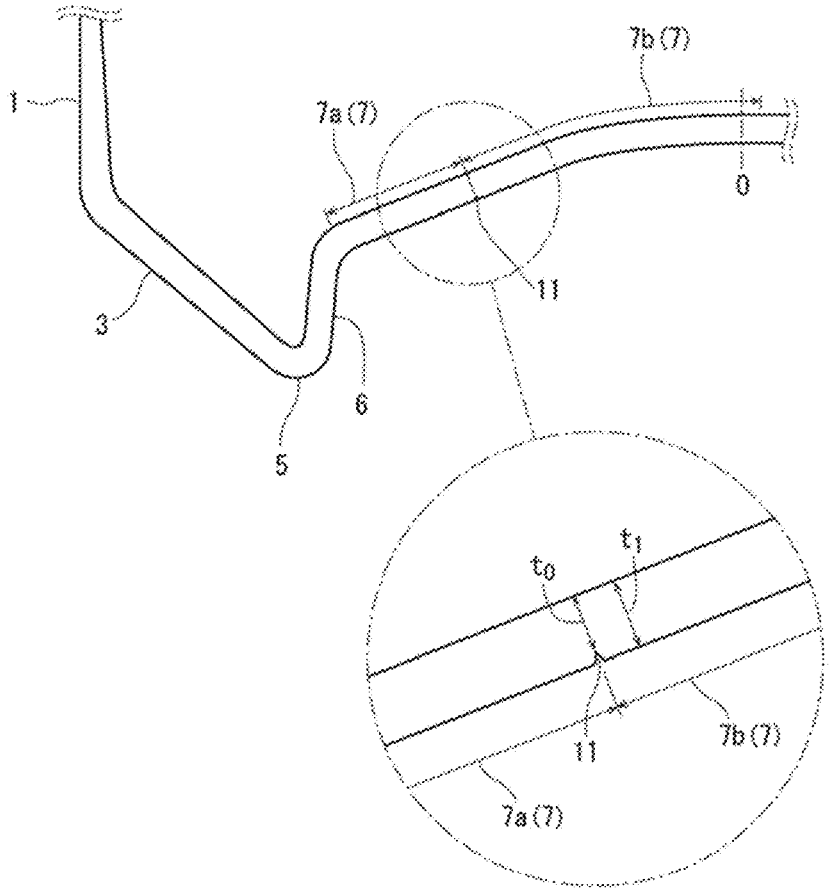
FIG. 2 is an enlarged partial side cross-sectional view of a bottom portion of the bottomed metal cylinder in FIG. 1.
Figure 3:
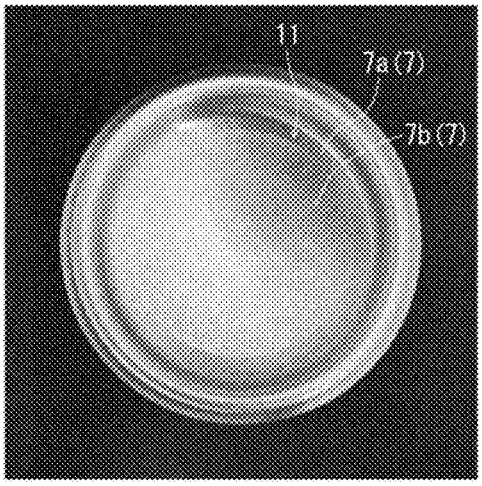
FIG. 3 is a bottom surface photograph of the bottomed metal cylinder in FIG. 1.

With reference to FIG. 1 as well as to an enlarged partial side cross-sectional view of the bottom portion in FIG. 2 and a bottom surface photograph in FIG. 3, an important feature of the disclosure is that an annular line 11 is observed at a boundary portion between the peripheral edge portion 7*a* and the center portion 7*b* of the dome-shaped bottom surface 7 described above.

Figure 4:
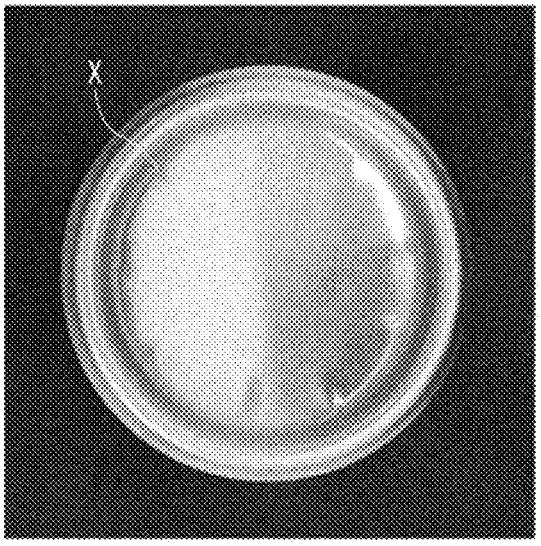
FIG. 4 is a bottom surface photograph of a known bottomed metal cylinder in the related art.

That is, such a dome-shaped bottom surface 7 is obtained by doming. However, in known bottomed metal cylinders in the related art, wrinkles X are present in a region corresponding to the peripheral edge portion 7*a* of the dome-shaped bottom surface 7 as illustrated in a bottom surface photograph in FIG. 4. In the disclosure, however, as is understood from the bottom surface photograph in FIG. 3, the annular line 11 is formed instead of the wrinkles X. As understood from the fact that the peripheral edge portion 7*a* originates from the doming ring used in doming as described above, this annular line 11 originates from an indentation of the doming ring, and a region outside and a region inside this annular line 11 is the peripheral edge portion 7*a* and the center portion 7*b*, respectively. Further, a thickness $t_0$ at this annular line 11 originating from a local thin portion is a thickness reduced by about 3 to 5% relative to a thickness $t_1$ at a position approximately 0.5 mm inward of the peripheral edge portion 7*a*, and the wrinkles X are eliminated by stretching. That is, in the disclosure, the annular line 11 is formed instead of the wrinkles X.

In such a bottomed metal cylinder 10, a thickness of the dome-shaped top surface 7 at a center portion O typically corresponds to a thickness of the thin element material plate used for this molding, and a thickness of the body portion 1 is determined in accordance with a degree of ironing (ironing rate).

For example, in the case of an aluminum seamless can used as a beverage can, a thickness of the element plate is about 0.180 to 0.350 mm, and a thickness of the thinnest area of the body portion 1 is 30 to 50% of that of the element plate.

Manufacture of Bottomed Metal Cylinder 10

The bottomed metal cylinder 10 according to the disclosure having a form such as described above is manufactured by molding using the metal element plate described above (organic resin coating may be provided on the side corresponding to the inner surface).

As for the molding process using a metal element plate such as described above, the bottomed cylinder 10 including the dome-shaped bottom surface 7 is obtained by punching, drawing, ironing, and doming as usual.

Figure 5A:
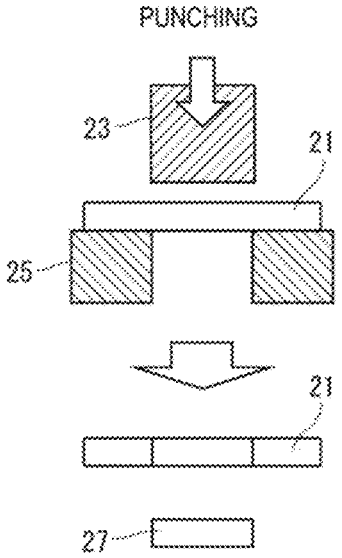
FIGS. 5(*a*) to 5(*c*) are views illustrating an overview of a process for manufacturing the bottomed metal cylinder in FIG. 1.
Figure 5B:
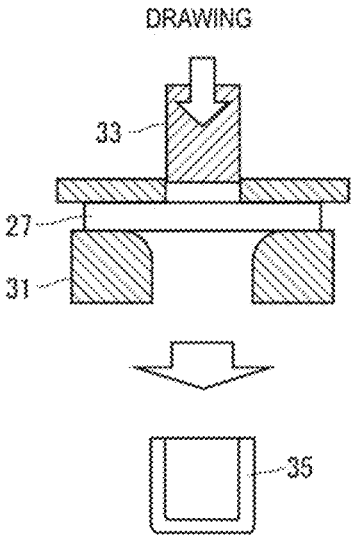
Figure 5C:
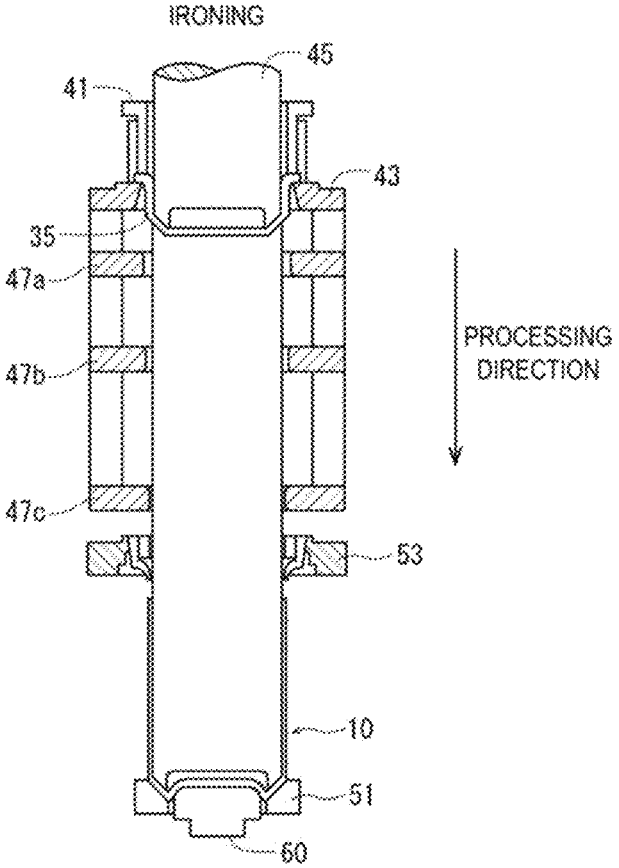

This process from punching to doming is illustrated in FIGS. 5(*a*) to 5(*c*).

That is, as illustrated in FIG. 5(*a*), an element plate 21 is punched by a punching punch 23 and a punching die 25 to obtain a circular plate 27 (punching process). Next, as illustrated in FIG. 5(*b*), a drawn cup (bottomed cylinder) 35 is obtained by a drawing die 31 and a drawing punch 33 (drawing process). Here, the obtained drawn cup 35 may be subjected to a doming process described below, but typically a re-drawing process and an ironing process are continuously performed as needed.

That is, as illustrated in FIG. 5(*c*), the drawn cup 35 held in a redraw die 43 by a presser 41 is pushed downward using an ironing punch 45, ironing is then performed through a plurality of ironing dies 47*a* to 47*c*, and subsequently doming is performed at the lowermost position. This doming is performed using a hold-down ring 51 and a doming die 61 described below. By this doming, the dome-shaped bottom surface 7 is formed simultaneously with the chime portion 3 and the ground contact portion 5 described above.

After doming, a stripper finger 53 is used to pull out the molded seamless can (bottomed metal cylinder) 10 from the punch 45, thereby completing this process. Subsequent post-processing, such as washing and drying and neck-in processing, is then performed.

In an ironing process such as described above, although three ironing dies are disposed in FIG. 5(*c*) and ironing is performed in three stages herein, the number of the ironing dies is not limited to three, and may be set to an appropriate number in accordance with a degree of intended thinning, and one die may be used for ironing in one stage, or two or more dies may be arranged for ironing in a plurality of stages. It is obvious that, in the case of a plurality of ironing dies being arranged in a processing direction and ironing being performed in a plurality stages, an inner diameter (working diameter) becomes smaller downstream in the processing direction.

In any case, after such ironing, doming is performed, forming the dome-shaped bottom surface 7.

Figure 6:
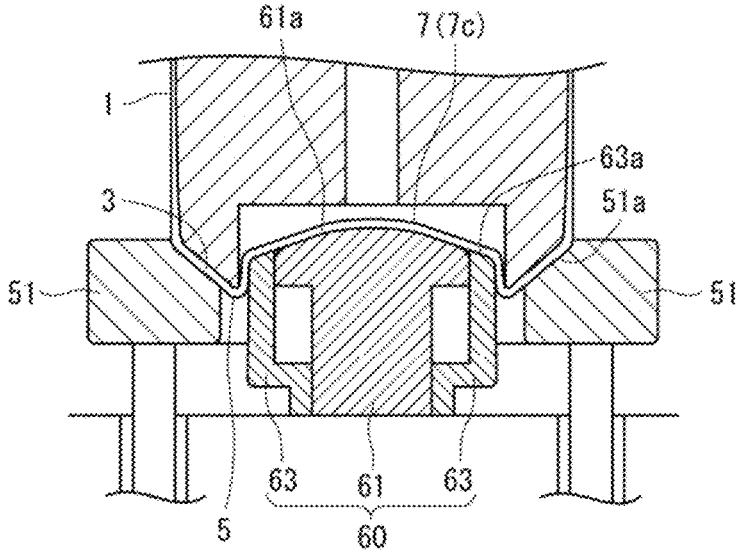
FIG. 6 is a view illustrating a molding die used in a doming process in FIGS. 5(*a*) to 5(*c*).
Figure 7A:
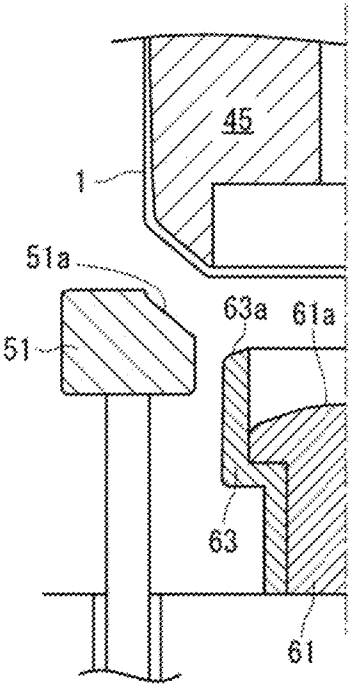
FIGS. 7(*a*) to 7(*d*) are views for describing the doming process of FIGS. 5(*a*) to 5(*c*).
Figure 7B:
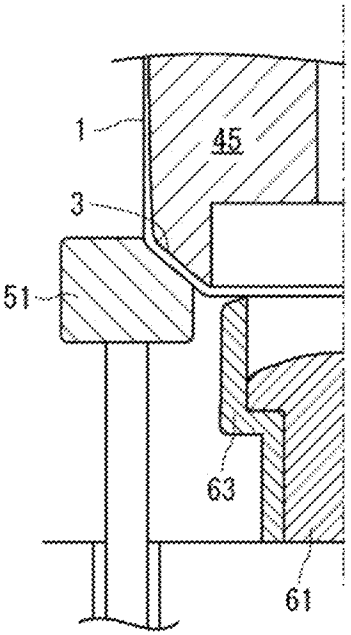
Figure 7C:
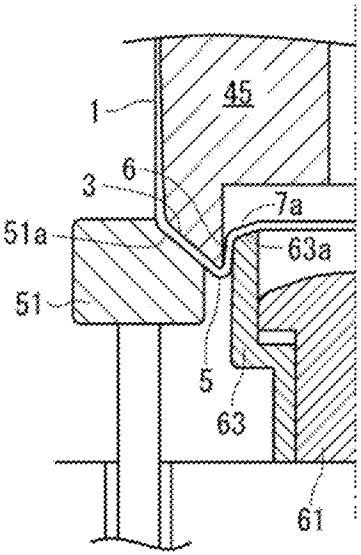
Figure 7D:
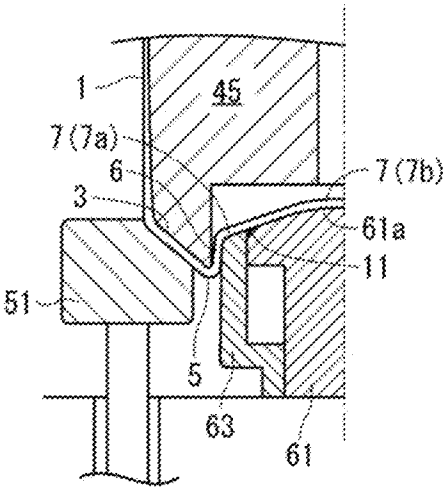

As illustrated in FIG. 6, the molding die used for doming includes the hold-down ring (annular holding die) 51 and a doming die 60, and doming is performed by a cooperative action of these molding dies and the punch 45. In the disclosure, the doming die 60 is divided into the base die 61 and a doming ring 63, and these are each provided independently vertically movable, which is an important feature.

That is, as understood from FIG. 6, in the hold-down ring (annular holding die) 51, a working surface 51*a* at an upper end is inclined inwardly downward, the chime portion 3 extending to the lower end of the body portion 1 is formed by this working surface 51*a*, and the ground contact surface 5 is formed at a lower end of the working surface 51*a*.

Further, the base die 61 is a die that defines the center portion 7*b* of the dome-shaped bottom surface 7, and a working surface 61*a* at an upper end thereof is a surface that corresponds to the center portion 7*b* of the dome-shaped bottom surface 7. Further, the doming ring 63 is a die that defines the peripheral edge portion 7*a* of the dome-shaped bottom surface 7, and a working surface 63*a* at an upper end thereof is a surface that corresponds to the peripheral edge portion 7*a* of the dome-shaped bottom surface 7. These working surfaces 61*a*, 63*a* are smoothly continuous to form the dome-shaped bottom surface 7.

As described above, the peripheral edge portion 7*a* of the dome-shaped bottom surface 7 is a portion where wrinkles are likely to occur and, with the die surface defining this portion made separate from the die surface defining the center portion 7*b*, stresses applied to the peripheral edge portion 7*a* of the dome-shaped bottom surface 7 are concentrated, thereby stretching the wrinkles that would thereby occur, avoiding the occurrence of wrinkles, and causing the annular line 11 to appear at a position corresponding to an inner end portion of the working surface 63*a* of the doming ring 63. That is, a length of this working surface 63*a* corresponds to a length of the peripheral edge portion 7*a* of the dome-shaped bottom surface 7 in a side cross-sectional view.

Doming using the molding die described above is carried out by the process illustrated in FIGS. 7(*a*) to 7(*d*).

The hold-down ring 51 is urged upward by air (not illustrated) and, in the initial stage, as illustrated in FIG. 7(*a*), the working surface 63*a* of the doming ring 63 is positioned downward of the working surface 51*a* of the hold-down ring 51, and the working surface 61*a* of the base die 61 is positioned further downward of the working surface 63*a* of the doming ring 63.

When the punch 45 is lowered in the state described above and the body portion 1 of the cylinder 10 is pushed downward, a lower end portion of the body portion 1 is pressed against the working surface 51*a* of the hold-down ring 51, forming the chime portion 3 at the lower end of the body portion 1, as illustrated in FIG. 7(*b*).

Next, when the doming ring 63 is raised, the ground contact portion 5 is defined, an inner side of the ground contact portion 5 is pulled up, defining the rising portion 6, and the working surface 63*a* of the doming ring 63 pushes up the surface inward of the rising portion 6, thereby defining the peripheral edge portion 7*a* of the dome-shaped bottom surface 7, as illustrated in FIG. 7(*c*).

When the peripheral edge portion 7*a* of the dome-shaped bottom surface 7 is formed as described above, as illustrated in FIG. 7(*d*), the base die 61 is arranged after a delay and the working surface 61*a* thereof is pressed against the bottom portion of the cylinder 10, thereby forming the center portion 7*b* of the dome-shaped bottom surface 7, which defines the domed-shaped bottom surface 7 and, in the area corresponding to an end portion of the working surface of the doming ring 63, the annular line 11 illustrated in FIGS. 2 and 3, and the like is observed. Thus, the occurrence of wrinkles is effectively prevented by the doming ring 63.

After doming is completed in this way, the punch 45 is pulled out, the obtained molded body is separated from the punch 45 by the stripper finger 53, and subsequent processes, such as washing, drying, neck-in processing, flange processing, and coating, are performed as described above to obtain a bottomed cylinder (seamless can) free of the occurrence of wrinkles on the bottom surface and having a high commercial value.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

The invention claimed is:

1. A method for dome-molding a bottom portion of a bottomed metal cylinder, the method comprising:

preparing a molding die, the molding die comprising:

an annular holding die for holding a bottom portion peripheral edge of the bottomed metal cylinder; and a doming die for defining a dome-shaped bottom surface, wherein the doming die is divided into a doming ring for defining a peripheral edge portion of the dome-shaped bottom surface, and a base die for defining a center portion of the dome-shaped bottom surface inward of the peripheral edge portion;

the doming ring is configured so that an inner end portion of its working surface is pressed against the domed-shaped bottom surface to form an annular dent at a boundary portion between the peripheral edge portion and the center portion; and the doming ring and the base die are each independently vertically movable;

lowering a punch sleeve from inside the bottomed metal cylinder and pressing a lower end peripheral edge portion of the cylinder against a working surface of the annular holding die, to form a chime portion and a ground contact portion at a bottom surface peripheral edge portion of the cylinder;

raising the doming ring while holding the chime portion and the ground contact portion of the cylinder by the punch sleeve and the working surface of the annular holding die to form a rising portion inside the ground contact portion, and pushing up a surface inward of the rising portion by the working surface of the doming ring to form the peripheral edge portion of the dome-shaped bottom surface; and after forming the chime portion, arranging the base die so that its working surface is pressed against the bottom portion of the cylinder to form the center portion of the dome-shaped bottom surface, wherein at the boundary portion between the peripheral edge portion and the center portion of the dome-shaped bottom surface, an annular line is formed originating from the annular dent such that a thickness $t_0$ at the annular line is a thickness reduced by about 3 to 5% relative to a thickness $t_1$ at a position approximately 0.5 mm inward of the peripheral edge portion.

* * * * *